US007214144B2

(12) United States Patent
Tseng

(10) Patent No.: US 7,214,144 B2
(45) Date of Patent: May 8, 2007

(54) GOLF CLUB HEAD WITH SHOCK ABSORBING MATERIAL EMBEDDED THEREIN

(75) Inventor: Wen-Cheng Tseng, 14F, No. 66, Kuanghua 2 Rd., Chienchen Dist., Kaohsiung (TW)

(73) Assignees: Wen-Cheng Tseng (TW); Kung-Wen Lee (TW); Super Way Technology Co., Ltd. (TW)

( * ) Notice: Subject to any disclaimer, the term of this patent is extended or adjusted under 35 U.S.C. 154(b) by 267 days.

(21) Appl. No.: 10/937,510

(22) Filed: Sep. 10, 2004

(65) Prior Publication Data

US 2006/0025236 A1 Feb. 2, 2006

(30) Foreign Application Priority Data

Jul. 28, 2004 (TW) ..... 93122480 A

(51) Int. Cl.
*A63B 53/04* (2006.01)

(52) U.S. Cl. ..... 473/345; 473/350

(58) Field of Classification Search ..... 473/329, 473/332, 342, 345, 346, 349, 350
See application file for complete search history.

(56) References Cited

U.S. PATENT DOCUMENTS

| | | | | | |
|---|---|---|---|---|---|
| 5,244,211 | A * | 9/1993 | Lukasiewicz | 473/305 |
| 5,351,958 | A * | 10/1994 | Helmstetter | 473/346 |
| 5,425,538 | A * | 6/1995 | Vincent et al. | 473/342 |
| 5,467,983 | A * | 11/1995 | Chen | 473/342 |
| 5,524,331 | A * | 6/1996 | Pond | 29/527.4 |
| 5,547,427 | A * | 8/1996 | Rigal et al. | 473/345 |
| 5,643,111 | A * | 7/1997 | Igarashi | 473/332 |
| 5,743,813 | A * | 4/1998 | Chen et al. | 473/329 |
| 2002/0019265 | A1 * | 2/2002 | Allen | 473/329 |

* cited by examiner

*Primary Examiner*—Nini F. Legesse
(74) *Attorney, Agent, or Firm*—Fei-Fei Chao; Andrews Kurth LLP

(57) ABSTRACT

A golf club head includes a hollow body with a side hole, a striking face securely connected to the hollow body to cover the side hole, a baffle formed inside the hollow body to be near to a peripheral edge defining the side hole so as to define between the striking face and the baffle a receiving space and a shock absorbing material inserted into the receiving space and securely attached to side walls defining the receiving space.

11 Claims, 4 Drawing Sheets

GOLF CLUB HEAD WITH SHOCK ABSORBING MATERIAL EMBEDDED THEREIN

BACKGROUND OF THE INVENTION

1. Field of the Invention

The present invention relates to a golf club head, and more particularly to a golf club head with shock absorbing material embedded inside the golf club head to absorb shock from the striking of a golf ball.

2. Description of Related Art

When a golfer is striking a golf ball, the counter force from the golf ball is applied directly to the golf club, which in turn is transmitted to the golfer. Therefore, after years of golfing on the golf courses, the accumulated stress on the golfer is enormous. The most common ailment from golfing due to the counter force is the wrist injury. This is because the golfer's wrist receives most the counter force so that after a period of time enjoying this past time, most golfers need to seek professional help to treat the discomfort.

In order to avoid the discomfort, especially when striking the golf ball, most golf club manufacturers nowadays install shock absorbing material inside the golf club head to reduce the shock to the golfer. Because the shock absorbing material can not withstand the heat during a welding process while manufacturing the golf club head, the shock absorbing material normally has a size slightly larger than the space inside the golf club head such that the manufacturer has to stuff the shock absorbing material inside the space in the golf club head. Thereafter, the manufacturer uses a cap and positioning elements such as screws, bolts or the like to secure the position of the shock absorbing material. However, this process will inevitably increase the cost in making the required mold and the shock absorbing material, after being pressed into the space inside the golf club head, is not able to effectively absorb the shock. Thus the conventional structure and method of stuffing the shock absorbing material inside the golf club head are not complete solutions to the existing problems.

To overcome the shortcomings, the present invention tends to provide an improved golf club head to mitigate the aforementioned problems.

SUMMARY OF THE INVENTION

The primary objective of the present invention is to provide an improved golf club head with shock absorbing material embedded inside the golf club head to effectively absorb shock from striking the golf ball.

Another objective of the present invention is to provide a baffle inside the golf club head to be spaced apart from the striking face so as to define therebetween a receiving space to receive therein a shock absorbing material.

To further strengthen the baffle, the baffle has ribs formed on a side face opposed to the striking face.

Other objects, advantages and novel features of the invention will become more apparent from the following detailed description when taken in conjunction with the accompanying drawings.

DETAILED DESCRIPTION OF THE PREFERRED EMBODIMENT

Figure 1:
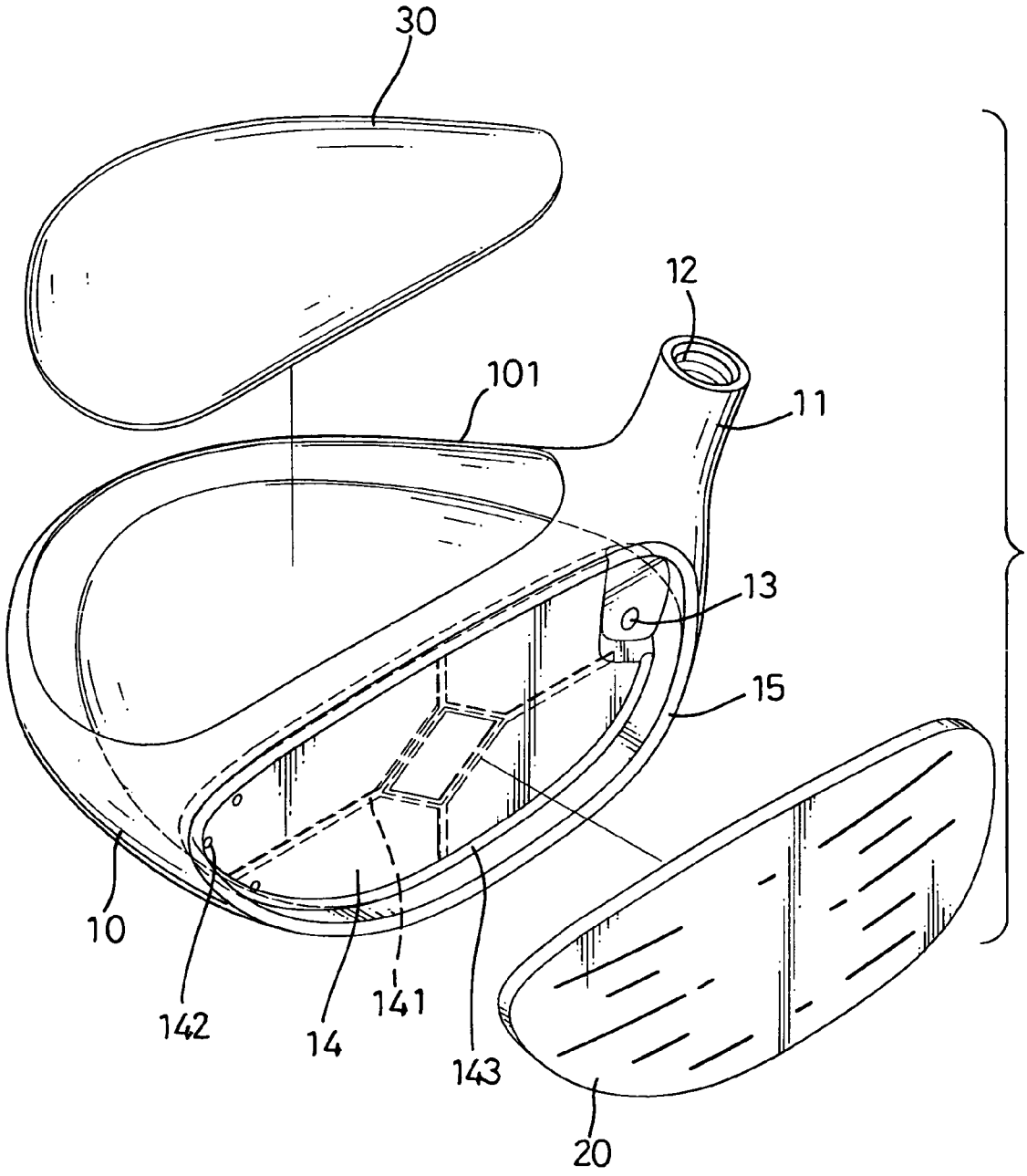
FIG. 1 is an exploded perspective view of the golf club head.
Figure 2:
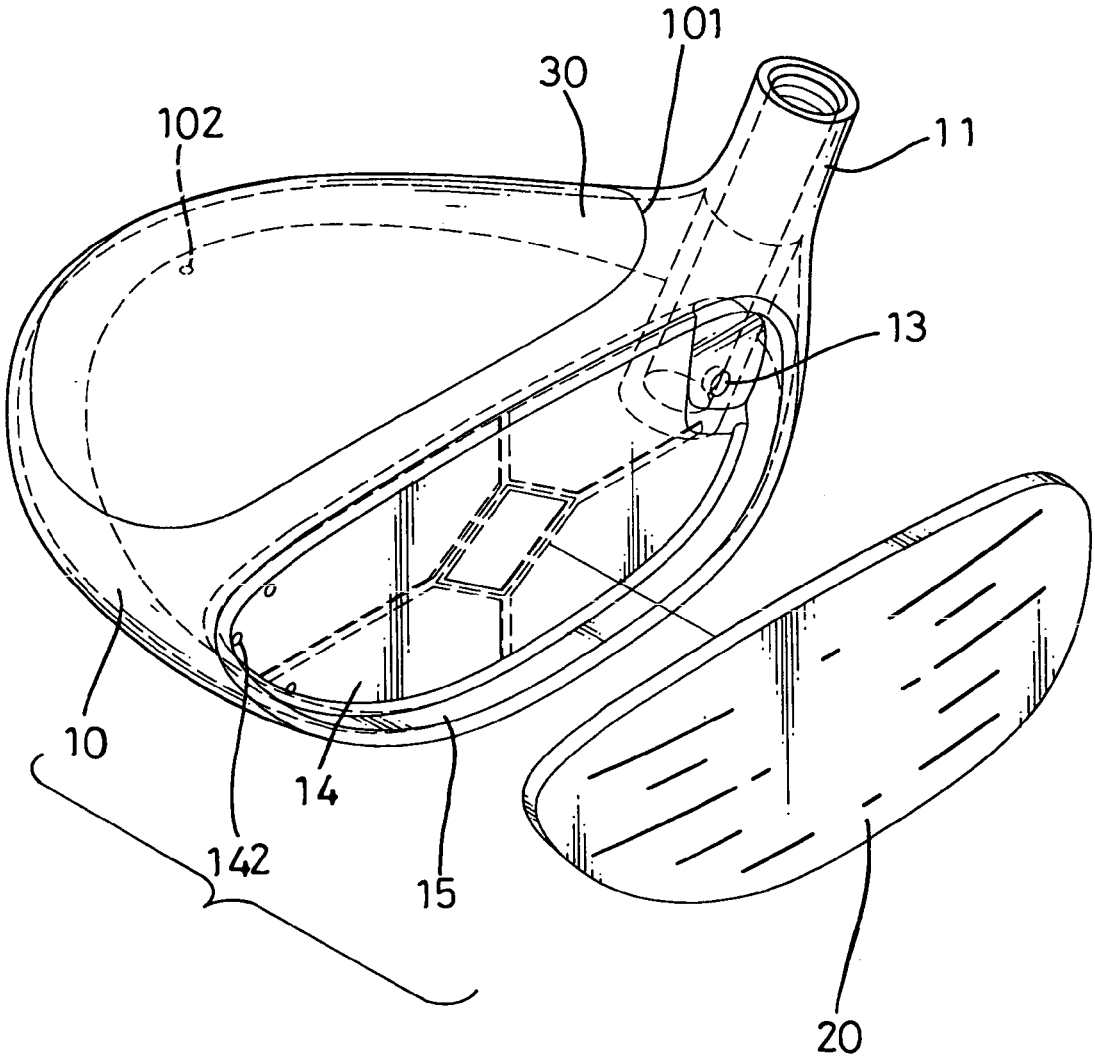
FIG. 2 is an exploded perspective view after the top cover is assembled.

With reference to FIGS. 1 and 2, the golf club head in accordance with the present invention includes a hollow body (10), a striking face (20) and a top cover (30).

The hollow body (10) has a neck (11) extending from one end of the hollow body (11) to receive therein a golf club (not shown), a threaded hole (12) is defined through the neck (11) to communicate with the interior of the hollow body (10) and a through hole (13) defined through an outer face of the hollow body (10) to communicate with the interior of the hollow body (10). An opening (101) is defined to mate with the top cover (30) and a side hole (15) is defined to mate with the striking face (20).

A baffle (14) is formed inside the hollow body (10) to be close to a peripheral edge of the side hole (15). The baffle (14) is substantially a plate with a rear surface enclosed in the body (10) and a front surface facing the side hole (15).The rear surface has a cruciform rib structure protruded therefrom, and an intersection portion of the cruciform rib is configured as a diamond shape. At least one air escape hole and preferably three escape holes are defined through the baffle (14) at a portion distant from the through hole (13). A recess (143) extends along a lower periphery of the front surface.

Figure 3:
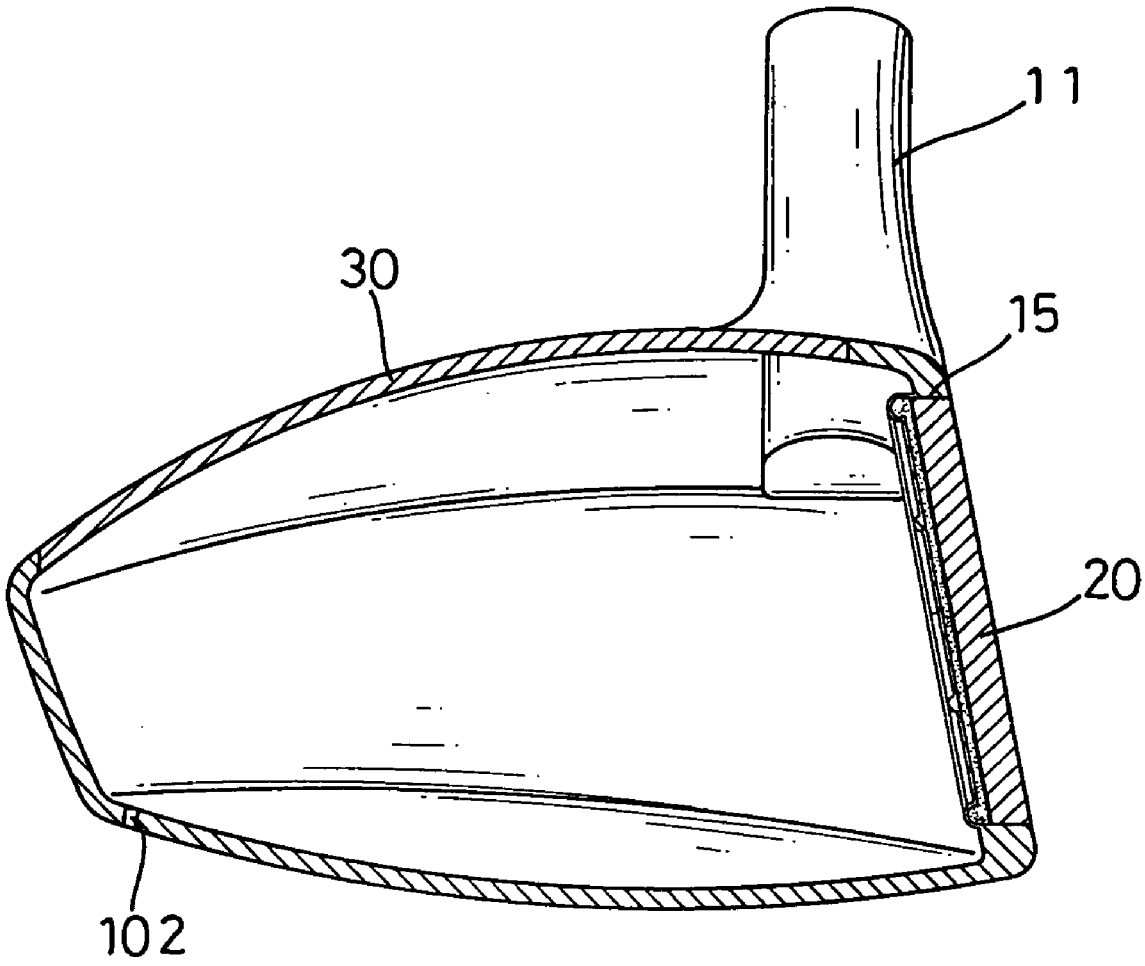
FIG. 3 is a cross sectional view showing the inner structure of the golf club head of the present invention.
Figure 4:
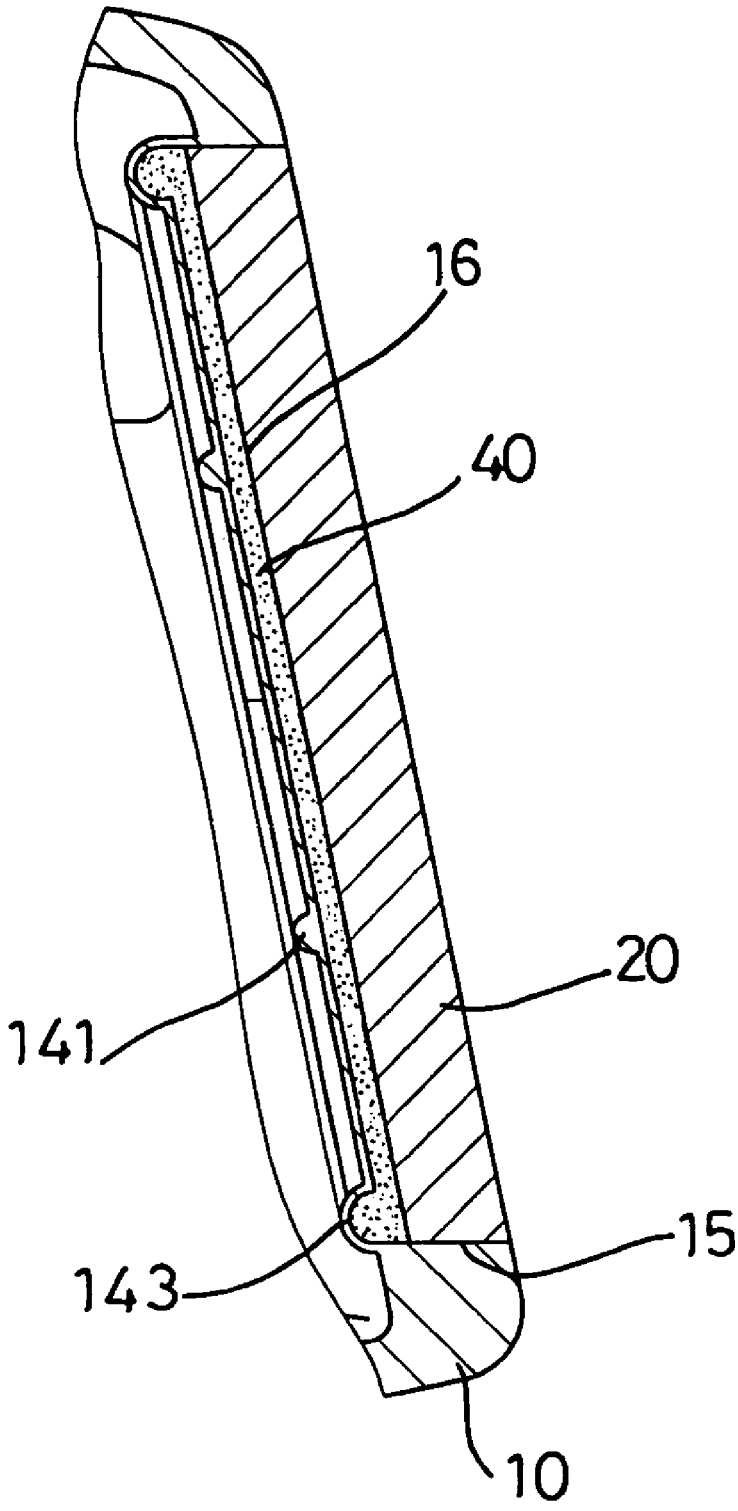
FIG. 4 is an enlarged schematic view in cross section to show that the shock absorbing material is sandwiched between the striking face and the baffle.

With reference to FIGS. 3 and 4, it is noted that after the top cover (30) and the striking face (20) are respectively mounted to cover the opening (101) and the side hole (15), a receiving space (16) is defined between the striking face (20) and the baffle (14). Further, the provision of the recess (143) is able to prevent the baffle (14) from being otherwise damaged from the heat from the welding of the striking face (20) to the hollow body (10).

Thereafter, due to the communication among the threaded hole (12), the through hole (13) and the interior of the hollow body (10), the manufacturer is able to add in a shock absorbing material (40) via the through hole (13) with the threaded hole (12) being blocked by any appropriate device. After the receiving space (16) is filled with shock absorbing material (40), the shock absorbing material (40) is hardened inside the receiving space (16) by a known process and thus the through hole (13) is blocked. Because the shock absorbing material (40) is hardened in the receiving space (16), the shock absorbing material (40) is able to securely adhere to side walls defining the receiving space (16). This is because the shock absorbing material (40) normally has adhesion ability such that while the shock absorbing material (40) is hardening, the adhesion ability of the shock absorbing material (40) is able to securely connect the shock absorbing material (40) to the side walls of the receiving space (16).

In order to have the best weight ratio of the golf club head, the baffle (14) has a thickness between 0.2~0.3 mm and the rib (141) has a thickness of 1 mm.

It is to be noted that when the receiving space (16) is gradually filled with the shock absorbing material (40), air inside the receiving space (16) will escape from the air escape holes (142) to the interior of the hollow body (10). Then the air will escape from a slit (102) defined through a periphery of the hollow body (10) to the surrounding atmosphere.

In summary, because the shock absorbing material (40) is able to securely adhere to the side walls defining the receiving space (16), when the striking face (20) is used to strike the golf ball, the shock wave from the striking motion will be effectively absorbed by the shock absorbing material (40) and thus the golfer's wrist is protected.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a golf club head comprising the steps of:

preparing a hollow body with an opening to mate with a top cover, a neck extending from a portion of the hollow body and a side hole to mate with a striking face;

forming a baffle inside the hollow body to be near a peripheral edge defining the side hole; wherein the baffle has a recess along the peripheral edge of the side hole;

defining a receiving space sandwiched between the striking face and the baffle;

defining a threaded hole in the neck, a through hole extending through the hollow body to communicate with an interior of the hollow body;

defining at least one air escape hole in the baffle to allow air inside the receiving space to escape to the interior of the hollow body; and filling the receiving space with a shock absorbing material via the through hole.

2. The method as claimed in claim 1, further comprising a step of defining a slit in the hollow body to communicate with the air escape holes after the air escape holes defining step to allow the air inside the hollow body to escape out of the hollow body.

3. A golf club head made by the method as claimed in claim 1, wherein the golf club head comprises:

a hollow body with a side hole;

a striking face securely connected to the hollow body to cover the side hole;

a baffle formed inside the hollow body to be near a peripheral edge defining the side hole so as to define between the striking face and the baffle a receiving space; wherein the baffle has a recess defined along a peripheral edge of the baffle to avoid damage to the baffle when the striking face is secured to the hollow body;

at least one air escape hole defined in the baffle to allow air in the receiving space to escape to an interior of the hollow body; and a shock absorbing material inserted into the receiving space and securely attached to side walls defining the receiving space.

4. The golf club head as claimed in claim 3, wherein a through hole is defined through the hollow body to enable the shock absorbing material to be inserted into the receiving space.

5. The golf club head as claimed in claim 4, wherein the baffle has ribs formed on a side face opposed to the striking face.

6. The golf club head as claimed in claim 3, wherein the baffle has ribs formed on a side face opposed to the striking face so that strength of the baffle is reinforced.

7. The golf club head as claimed in claim 3 further comprising a slit defined through the hollow body to communicate with the air escape holes to allow air in the hollow body to escape out of the hollow body.

8. The golf club head comprising:

a hollow body with a side hole;

a striking face securely connected to the hollow body to cover the side hole;

a baffle formed inside the hollow body to be near a peripheral edge defining the side hole so as to define between the striking face and the baffle a receiving space and at least one air escape hole defined in the baffle to allow air in the receiving space to escape to an interior of the hollow body; and shock absorbing material inserted into the receiving space and securely attached to side walls defining the receiving space, wherein a slit is defined through the hollow body to communicate with the at least one air escape hole to allow air in the hollow body to escape out of the hollow body.

9. The golf club head as claimed in claim 8, wherein a through hole is defined through the hollow body to enable the shock absorbing material to be inserted into the receiving space.

10. The golf club head as claimed in claim 9, wherein the baffle has ribs formed on a side face opposed to the striking face so that a strength of the baffle is reinforced.

11. The golf club head as claimed in claim 10, wherein the baffle has a recess defined along a peripheral edge of the baffle to avoid damage to the baffle when the striking face is secured to the hollow body.

* * * * *